US007513315B2

(12) United States Patent
Boyle et al.

(10) Patent No.: US 7,513,315 B2
(45) Date of Patent: Apr. 7, 2009

(54) SYSTEM AND METHOD FOR TESTING FOAM-WATER FIRE FIGHTING AND FIRE SUPPRESSION SYSTEMS

(76) Inventors: Thomas J. Boyle, 2812 Banwick Rd., Columbus, OH (US) 43232; Patrick A. Smith, 171 Township Road 185, Junction City, OH (US) 43748

( * ) Notice: Subject to any disclaimer, the term of this patent is extended or adjusted under 35 U.S.C. 154(b) by 288 days.

(21) Appl. No.: 11/353,381

(22) Filed: Feb. 14, 2006

(65) Prior Publication Data

US 2006/0151184 A1 Jul. 13, 2006

Related U.S. Application Data

(63) Continuation of application No. 09/989,783, filed on Nov. 20, 2001, now Pat. No. 7,080,694.

(51) Int. Cl.
*A62C 35/00* (2006.01)
*A62C 2/00* (2006.01)

(52) U.S. Cl. ..... 169/16; 169/43

(58) Field of Classification Search ..... 169/14–16, 169/43, 44; 239/310, 124, 127, 398, 400, 239/407, 416.1, 417.5, 67–71; 417/43, 46; 73/117, 61.62, 61.71, 49.5
See application file for complete search history.

(56) References Cited

U.S. PATENT DOCUMENTS

| | | | | |
|---|---|---|---|---|
| 4,599,890 | A | 7/1986 | Girone et al. | |
| 4,729,403 | A | 3/1988 | Roche | |
| 5,297,736 | A | 3/1994 | Vickery | |
| 5,320,138 | A | 6/1994 | Ferlitch, Jr. | |
| 5,881,818 | A | 3/1999 | Lee et al. | |
| 5,944,051 | A | 8/1999 | Johnson | |
| 6,725,940 | B1 * | 4/2004 | Klein et al. | 169/15 |
| 7,080,694 | B2 * | 7/2006 | Boyle | 169/14 |
| 7,140,552 | B1 * | 11/2006 | Crabtree et al. | 239/1 |
| 2005/0222287 | A1 | 10/2005 | Roberts | |

FOREIGN PATENT DOCUMENTS

| | | |
|---|---|---|
| DE | 30 38 334 | 10/1982 |
| DE | 10 2004 032020 | 1/2006 |
| WO | 03/042092 | 5/2003 |

OTHER PUBLICATIONS

International Search Report dated Sep. 4, 2007 in PCT/US2007/061845.

* cited by examiner

*Primary Examiner*—Davis Hwu
(74) *Attorney, Agent, or Firm*—McNees Wallace & Nurick LLC

(57) ABSTRACT

A test system for proportioning fire fighting and fire suppression systems is provided. This test system includes a foam-water proportioning system and at least one test apparatus connectable to or incorporated into the foam-water sprinkler system. In an exemplary embodiment, the foam-water proportioning system further includes: (i) at least one proportioning valve; (ii) at least one source of water; and (iii) at least one source of foam concentrate. The test apparatus further includes: (i) a means for bypassing the at least one source of foam concentrate; (ii) a first flow meter; and (iii) an optional second flow meter.

24 Claims, 3 Drawing Sheets

SYSTEM AND METHOD FOR TESTING FOAM-WATER FIRE FIGHTING AND FIRE SUPPRESSION SYSTEMS

CROSS-REFERENCE TO RELATED APPLICATIONS

This patent application is a continuation-in-part of U.S. patent application Ser. No. 09/989,783 filed on Nov. 20, 2001 and entitled "Method and System for Testing Foam-Water Fire Protection Systems".

TECHNICAL FIELD OF THE INVENTION

This invention relates in general to systems for testing fire fighting and/or fire suppression systems, and more specifically to a system and method for periodic testing of fire fighting and/or fire suppression systems that utilize a combination of fire-fighting foam and water.

BACKGROUND OF THE INVENTION

Fire-fighting foam is a stable aggregation of small bubbles having a lower density than oil or water, and typically exhibits tenacity for covering horizontal surfaces. Mixing air into a solution of water that contains foam concentrate creates air foam. Air foam tends to flow freely over a burning liquid surface and form a tough, air-excluding, continuous blanket that seals volatile combustible vapors from access to air. A foam blanket of this nature resists disruption from wind and draft, or heat and flame attack, and is capable of resealing in case of mechanical rupture. Fire-fighting foams usually retain such properties for relatively long periods of time and are useful for fighting fires in many ordinary combustible materials, such as wood, cloth, paper, rubber, and many plastics; as well as fires in many flammable liquids, oils, greases, tars, oil base paints, lacquers, and flammable gases.

The uses of foam for fire fighting and fire suppression have increased greatly since the foam was first used in the 1930s. As the technology for using the foam developed over the years, new systems for applying foam were developed, as were new foam-forming liquid concentrates. A relatively early development (circa 1954) included the application of foam from overhead sprinkler-type systems using specially designed foam-making nozzles. These nozzles were capable of forming foam from protein-type foam concentrate solutions, or delivering a satisfactory water discharge pattern when supplied only with water. By way of example, protein, fluoroprotein, aqueous film-forming concentrates, and film-forming fluoroprotein foam (AFFF) concentrates are materials suitable for use with foam-water sprinkler systems.

Foam-water sprinkler systems are typically pipe-connected to both a source of foam concentrate and a source of water. These systems are also equipped with appropriate devices for discharging and distributing a foam/water solution over a particular area. The discharge devices are connected to the water supply by way of a control valve, known as a "proportioning valve", which is usually actuated by automatic detection equipment installed in the same areas as the discharge devices. When the proportioning valve opens, water flows through the valve and is mixed with foam concentrate that is simultaneously injected into the water stream. The resulting foam solution is then discharged from the system though the various discharge devices. Upon exhaustion of the supply of foam concentrate, water discharge typically continues until it is shut off manually. Existing deluge sprinkler systems that have been converted to aqueous film forming foam or film forming fluoroprotein foam systems are usually considered to be foam-water sprinkler systems.

In general, "proportioning" is the process of mixing or combining two or more ingredients into a common product at a predetermined ratio. For fire fighting and suppression, there are numerous known proportioning systems and methods, including: (i) the premixed foam solution method; (ii) Venturi (vacuum inducing); (iii) pressure proportioning; (iv) bladder tank proportioning; (v) balance pressure proportioning; (vi) in-line balanced pressure proportioning; (vii) around the pump proportioning; (viii) pick-up nozzles; and (ix) jet pump proportioning. It is important that a proportioning system be able to consistently maintain the correct ratio of foam concentrate to water across the entire proportioning range indicated by a particular system. If proportioning is too "lean" (i.e., less than the design-specified percentage of foam to water), the overall foam quality decreases. The drainage time decreases and the bubbles break faster, thereby resulting in less resistance to heat. Thus, lean foam may not put out the fire. Alternately, if proportioning is too rich (i.e., greater than the design-specified percentage of foam concentrate to water), the foam will exhibit stiffness and non-fluidity or reluctance to flow around obstructions. Additionally, the supply of foam concentrate will be depleted more rapidly and may not adequately meet minimum operating time requirements. Thus, the overall operability and performance of a proportioning system should be characterized; both when the system is installed and at regular intervals thereafter.

As an international standards organization, the National Fire Protection Association (NFPA) has developed standards for the testing of certain fire-related equipment, including foam-water sprinkler systems and other systems. Among these standards are Standards 11, 16, 25 and 409. Standard 25 ("NFPA 25") is the "Standard for Inspection, Testing, and Maintenance of Water-Based Fire Protection Systems" and requires inspection, testing, and maintenance of water-based fire protection systems. NFPA 25 provides guidelines for each inspection, testing, and maintenance activity that must be performed on a daily, weekly, monthly, quarterly, annually, or over 5, 10, and 20-year intervals. Compliance with NFPA 25 is important for reasons of: (i) owner liability, because the standard clearly places the responsibility for a working sprinkler system on the owner of the building in which the system has been installed; and (ii) cost, because performing regular maintenance helps avoid the expense associated with repairing or replacing multiple system components all at once. However, due to expense commonly associated with testing (e.g., of the foam itself and of disposing of the foam used in the test), and other difficulties associated with actually conducting an adequate system tests, many foam-water sprinkler systems are seldom, if ever, tested by building owners or other responsible parties. As a result, many of these systems may operate less than optimally or may fail when they are needed. Thus, there is a need for an effective and inexpensive system and method for testing fire fighting and fire suppression systems that utilize solutions of water and fire fighting foam.

SUMMARY OF THE INVENTION

The following provides a summary of exemplary embodiments of the present invention. This summary is not an extensive overview and is not intended to identify key or critical aspects or elements of the present invention or to delineate its scope.

In accordance with one aspect of the present invention, a test system is provided. An exemplary embodiment of this test system includes a foam-water proportioning system and at least one test apparatus connectable to or incorporated into the foam-water proportioning system. Thus, this test system may be used with mobile systems, i.e., fire fighting systems, or with fixed systems, i.e., fire suppression systems. In an exemplary embodiment, the foam-water proportioning system further includes: (i) at least one proportioning valve; (ii) at least one source of water; (iii) at least one water supply line, wherein the at least one water supply line connects the at least one source of water to the at least one proportioning valve; (iv) at least one source of foam concentrate; (v) at least one foam supply line, wherein the at least one foam supply line connects the at least one source of foam concentrate to the at least one proportioning valve; and wherein the at least one proportioning valve mixes water with foam concentrate to form a solution; and (vi) at least one solution supply line, wherein the at least one solution supply line is connected to the at least one proportioning valve. The test apparatus further includes: (i) means for bypassing the at least one source of foam concentrate, wherein the means for bypassing the at least one source of foam concentrate is located in or on the at least one foam supply line; (ii) a first test line, wherein the first test line is connected to both the at least one water supply line and the means for bypassing the at least one source of foam; and (iii) a first flow meter in fluid communication with at least one of the first test line and the foam concentrate supply line, and wherein the first flow meter is located upstream from the at least one proportioning valve. The test apparatus may also include a second test line and a second flow meter, wherein the second test line connects the solution supply line to the second flow meter.

In accordance with another aspect of the present invention, a test method is provided. This test method includes the steps of installing or generally accessing an existing foam-water proportioning system and connecting at least one test apparatus to, or incorporating at least one apparatus into, the foam-water proportioning system. Thus, this test method may be used with mobile systems, i.e., fire fighting systems, or with fixed systems, i.e., fire suppression systems. In an exemplary embodiment, the foam-water proportioning system further comprises: (i) at least one proportioning valve; (ii) at least one source of water; (iii) at least one water supply line, wherein the at least one water supply line connects the at least one source of water to the at least one proportioning valve; (iv) at least one source of foam concentrate; (v) at least one foam supply line, wherein the at least one foam supply line connects the at least one source of foam concentrate to the at least one proportioning valve; and wherein the at least one proportioning valve mixes water with foam concentrate to form a solution; and (vi) at least one solution supply line, wherein the at least one solution supply line is connected to the at least one proportioning valve. The at least one test apparatus further comprises: (i) means for bypassing the at least one source of foam concentrate, wherein the means for bypassing the at least one source of foam concentrate is located in or on the at least one foam supply line; (ii) a first test line, wherein the first test line is connected to both the at least one water supply line and the means for bypassing the at least one source of foam concentrate; and (iii) a first flow meter in fluid communication with at least one of the first test line and the foam concentrate supply line, and wherein the first flow meter is located upstream from the at least one proportioning valve. In an exemplary embodiment, the test method further includes the steps of activating the foam-water proportioning system; performing at least one acceptance test to characterize the performance of the proportioning valve; activating the test apparatus, wherein activating the test apparatus further activates the means for bypassing the at least one source of foam concentrate and directs water from the at least one water supply line through the first test line and into and through the first flow meter; (f) recording water flow rates through the first flow meter; and (g) comparing the recorded water flow rates with the results of the acceptance test. The test apparatus may further include a second test line and a second flow meter, wherein the second test line connects the solution supply line to the second flow meter, and the test method may further include the step of recording water flow rates through the second flow meter following activation of the test apparatus. In other embodiments, the steps of activating the proportioning system, performing the acceptance test, and comparing the recorded water flow rates with the results of the acceptance test are omitted in favor of simply performing a "water equivalence test" using the test apparatus.

Additional features and aspects of the present invention will become apparent to those of ordinary skill in the art upon reading and understanding the following detailed description of the exemplary embodiments. As will be appreciated, further embodiments of the invention are possible without departing from the scope and spirit of the invention. Accordingly, the drawings and associated descriptions are to be regarded as illustrative and not restrictive in nature.

BRIEF DESCRIPTION OF THE DRAWINGS

The accompanying drawings, which are incorporated into and form a part of the specification, schematically illustrate one or more exemplary embodiments of the invention and, together with the general description given above and detailed description given below, serve to explain the principles of the invention, and wherein.

DETAILED DESCRIPTION OF THE INVENTION

Figure 1:
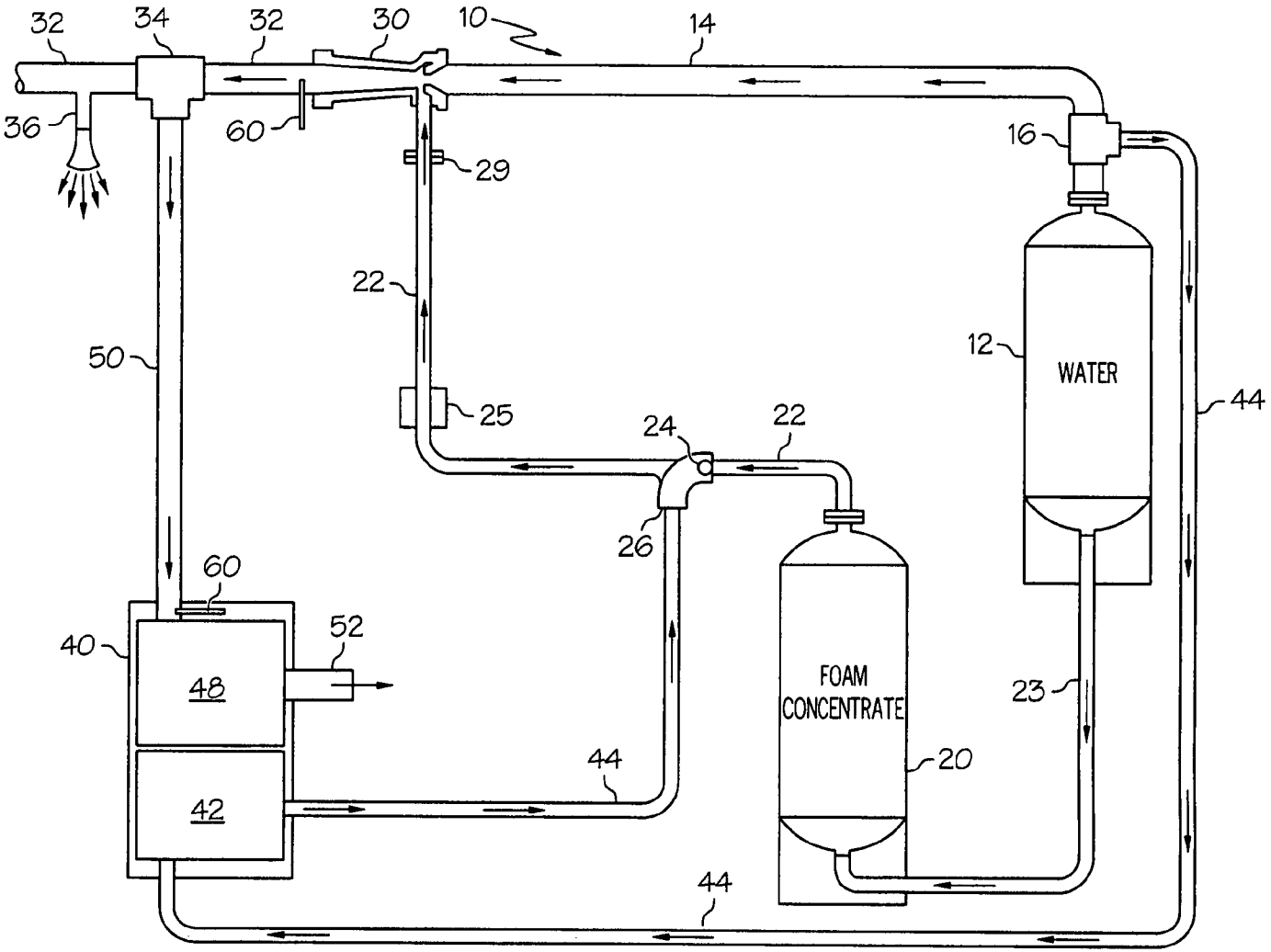
FIG. 1 is a simplified schematic representation of a foam-water proportioning system that includes a first exemplary embodiment of the test system of the present invention.

Exemplary embodiments of the present invention are now described with reference to the Figures. Reference numerals are used throughout the detailed description to refer to the various elements and structures. For purposes of explanation, numerous specific details are set forth in the detailed description to facilitate a thorough understanding of this invention. It should be understood, however, that the present invention may be practiced without these specific details. In other instances, well-known structures and devices are shown in block diagram form for purposes of simplifying the description.

This invention relates to a system and method for testing fire fighting systems and fire suppression systems that utilize foam and water. Such systems are often installed in fire trucks, ships, cargo airplanes or in buildings such as warehouses, airplane hangars or any number of other types of structures. A first general embodiment of this invention provides a test system, which includes a foam-water proportioning system and at least one test apparatus connectable to or incorporated into the foam-water sprinkler system. A second general embodiment of this invention provides a test method for testing the operability of foam-water proportioning systems, which includes the steps of installing a new, or accessing an existing, foam-water proportioning system and connecting at least one test apparatus to, or incorporating at least one test apparatus into, the foam-water proportioning system. In both general embodiments, the foam-water sprinkler system further includes: (i) at least one proportioning valve; (ii) at least one source of water; (iii) at least one water supply line, wherein the at least one water supply line connects the at least one source of water to the at least one proportioning valve; (iv) at least one source of foam concentrate; (v) at least one foam supply line, wherein the at least one foam supply line connects the at least one source of foam concentrate to the at least one proportioning valve; and wherein the at least one proportioning valve mixes water with foam concentrate to form a solution; and (vi) at least one solution supply line, wherein the at least one solution supply line is connected to the at least one proportioning valve. Also, in both general embodiments, the test apparatus further includes: (i) means for bypassing the at least one source of foam concentrate, wherein the means for bypassing the at least one source of foam concentrate is located in or on the at least one foam supply line; (ii) a first test line, wherein the first test line is connected to both the at least one water supply line and the means for bypassing the at least one source of foam; and (iii) a first flow meter in fluid communication with at least one of the first test line and the foam concentrate supply line, wherein the first flow meter is located upstream from the at least one proportioning valve. The test apparatus may also include a second test line and a second flow meter, wherein the second test line connects the solution supply line to the second flow meter.

With reference now to the Figures, FIG. 1 provides a highly simplified and generalized schematic representation of a first exemplary embodiment of test system 10. Test system 10 may be a separate, mobile and freestanding system, it may be fully integrated into a new foam-water proportioning system at the time the system is installed, or system 10 may be permanently integrated into an existing foam-water proportioning system. In FIG. 1, an exemplary foam-water proportioning system includes a source of water 12, which may be a reservoir or any other suitable source of water, connected to a proportioning valve 30 by a water supply line 14. A source of foam concentrate 20 is connected to proportioning valve 30 by a foam supply line 22, which may include an optional in-line booster pump 25. Pressure supply line 23 is connected to both source of water 12 and source of foam concentrate 20 and typically provides adequate water pressure for moving foam concentrate out of source of foam concentrate 20 (see also FIGS. 2 and 3). Proportioning valve 30 combines, i.e., mixes, foam concentrate with water to form a foam/water solution, which is then delivered to at least one solution dispersing device 36 by way of solution supply line 32. In some embodiments of this invention, a variable flow orifice 29 is included to control the flow (rate and/or volume) of foam concentrate into proportioning valve 30. Solution dispersing device 36 may be a sprinkler head or any other device suitable for delivering foam/water solution to an area to be treated. The percentage of foam to water in the foam/water solution is typically determined by the manufacturer of proportioning valve 30 and may vary significantly among different proportioning systems.

Again with reference to FIG. 1, the test apparatus may be configured as a moveable, portable, or semi-portable "test stand" 40 that further includes a first flow meter 42 or other measuring device and, optionally, a second flow meter 48 or other measuring device. As described in U.S. patent application Ser. No. 09/989,783, which is hereby incorporated by reference in its entirety, numerous other components may also be included in the test apparatus. In the exemplary embodiment shown in FIG. 1, a first flow meter 42 is connected to water supply line 14 by a first test line 44, which accesses the water supply line 14 at a first connector 16. First flow meter 42 is also connected to foam supply line 22 at second connector 26. Second connector 26 may include a shut-off valve 24, check valve, or other means for bypassing the source of foam concentrate 20 during testing operations. In this embodiment, an optional second flow meter 48 is connected to the solution supply line 32 by a second test line 50, which accesses the solution supply line 32 at third connector 34. Test water drawn from solution supply line 32 is expelled from second flow meter 48 through discharge line 52.

Figure 2:
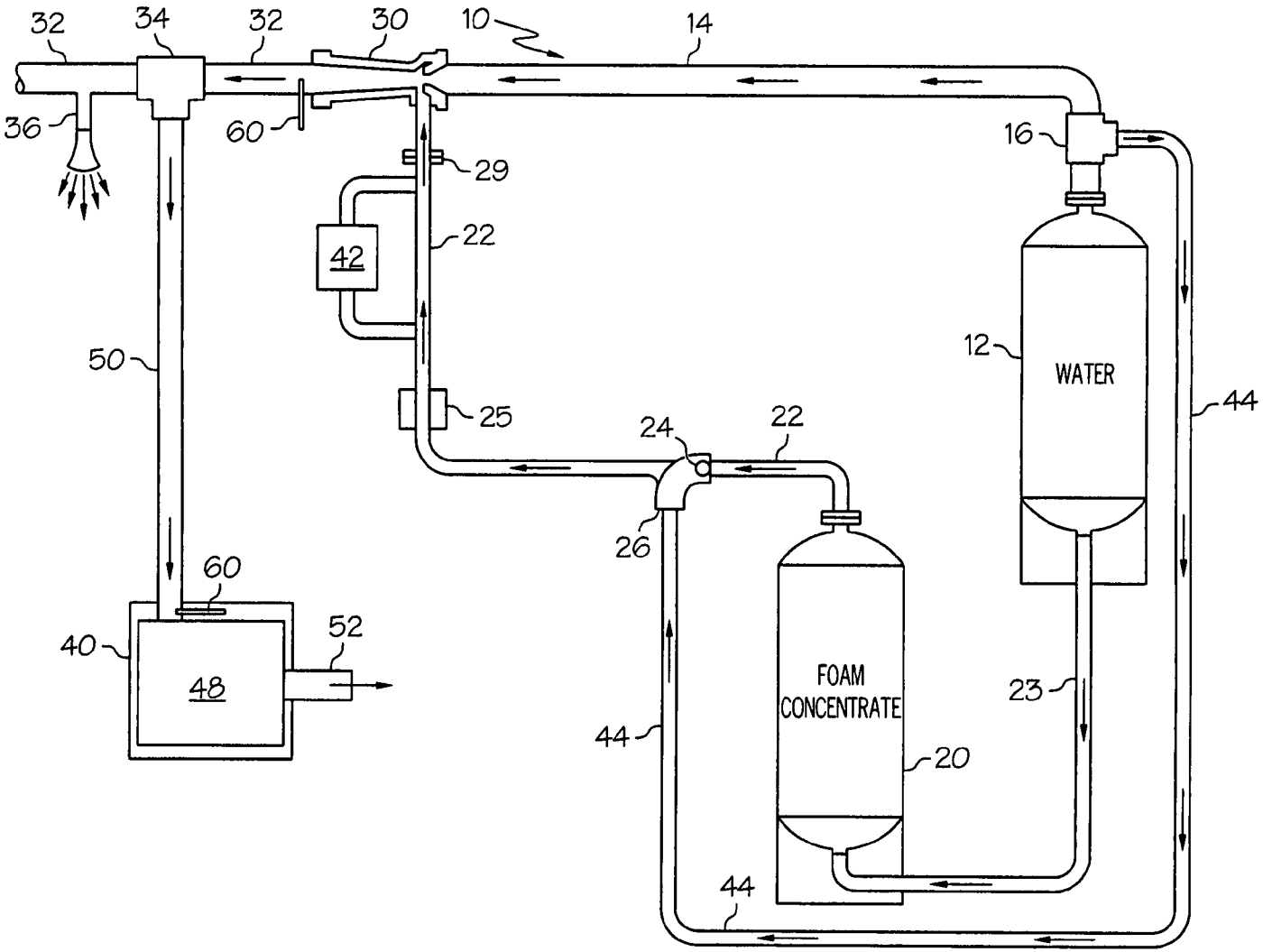
FIG. 2 is a simplified schematic representation of a foam-water proportioning system that includes a second exemplary embodiment of the test system of the present invention.

FIG. 2 provides a highly simplified and generalized schematic representation of a second exemplary embodiment of test system 10. In this embodiment, the test apparatus is typically incorporated into a new proportioning system or an existing proportioning system to permit system testing at regular intervals. In this embodiment, first flow meter 42 is located in or on foam supply line 22, downstream from bypass 24. During testing, water is diverted from water supply line 14, through first test line 44, into foam supply line 22 and though first flow meter 42 before entering proportioning valve 30. An optional second flow meter 48 is connected to the solution supply line 32 by a second test line 50, which accesses the solution supply line 32 at third connector 34. Test water drawn from solution supply line 32 is expelled from second flow meter 48 through discharge line 52.

Figure 3:
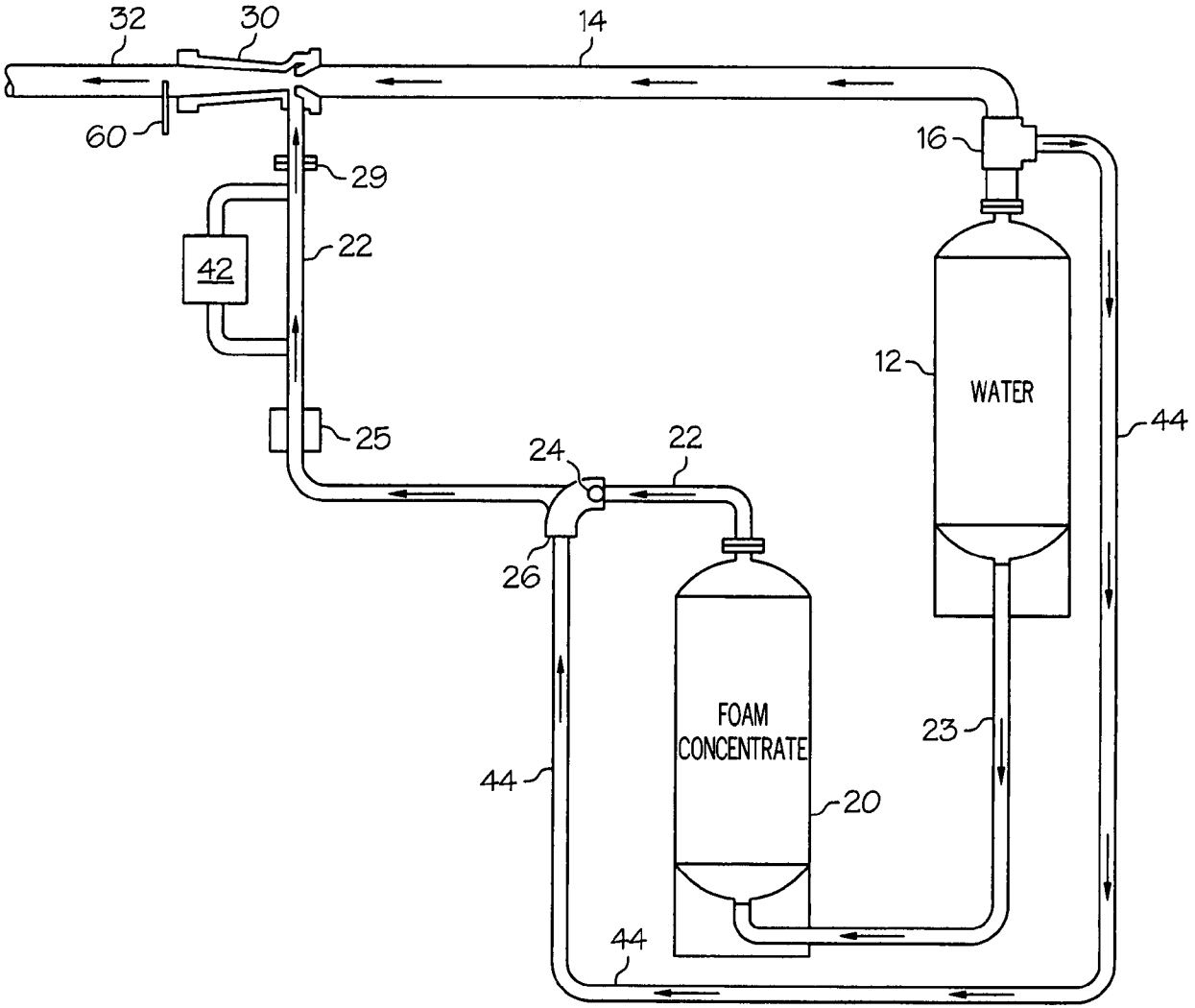
FIG. 3 is a simplified schematic representation of a foam-water proportioning system that includes a third exemplary embodiment of the test system of the present invention.

FIG. 3 provides a highly simplified and generalized schematic representation of a third exemplary embodiment of test system 10. In this embodiment also, the test apparatus is typically incorporated into a new proportioning system or an existing proportioning system to permit system testing at regular intervals. In this embodiment, first flow meter 42 is located in or on foam supply line 22, downstream from bypass 24. During testing, water is diverted from water supply line 14, through first test line 41, into foam supply line 22 and though first flow meter 42 before entering proportioning valve 30. In this embodiment, the second flow meter is absent and a hose monster or similar flow-measuring device is used to measure the flow of test water through or out of solution supply line 32.

The test apparatus, whether connected to or incorporated into an exiting proportioning system or included as part of a new proportioning system at the time of initial installation, is used to test the function and/or characterize the operability of the system according to the exemplary test method described below (which assumes that acceptable test data from previously performed acceptance tests is not available). First, the proportioning system is accessed and activated for a predetermined period of time. The performance of the proportioning valve is initially characterized by conducting an acceptance test, the data from which is compared to the manufacturer's specified flow rate and ratio of foam to water in solution for a particular valve, e.g., 400 gpm at 2%, 4% or 6% foam. Currently, there are two accepted methods for measuring foam concentrate percentages in water (see NFPA 16 (2004), Chapter 9, Annex A). Both methods are based on comparing foam solution test samples to pre-measured solutions, which are plotted on a baseline graph of percent concentration versus instrument reading.

Acceptance Test (Conductivity Method)

This method is based on changes in electrical conductivity as foam concentrate is added to water. A handheld conductivity meter is used to measure the conductivity of foam solutions in microsiemen units. Conductivity is typically a very accurate method, provided there are substantial changes in conductivity as foam concentrate is added to the water in relatively low percentages (i.e., 1 percent, 3 percent, or 6 percent). Foam and water solutions are made in advance to determine if adequate changes in conductivity can be detected if the water source is salty or brackish. A base (calibration) curve is prepared using the following materials: (i) four 100 ml plastic bottles with caps; (ii) one 10-ml measuring pipette or 10-cc syringe; (iii) one 100 ml graduated cylinder; (iv) three plastic-coated magnetic stirring bars; (v) one portable temperature-compensated conductivity meter (Omega Model CDH-70, VWR Scientific Model 23198-014, or equivalent); (vi) standard graph paper; and (vii) a ruler or other straightedge.

The conductivity method typically includes using water and foam concentrate from the system to be tested for making three standard solutions in the graduated cylinder. These samples should include the nominal intended percentage of injection, the nominal percentage plus 1 or 2 percentage points, and the nominal percentage minus 1 or 2 percentage points. When preparing the standard solutions, place the water in the graduated cylinder (leaving adequate space for the foam concentrate) and then carefully measure the foam concentrate samples into the water using the syringe. Care should be taken to not to pick up air in the foam concentrate samples. Pour each measured foam solution from the graduated cylinder into a 100 ml plastic bottle. Each bottle should be marked to indicate the percent solution it contains. Add a plastic stirring bar to the bottle, cap it, and shake thoroughly to mix the foam solution. After making the three foam solutions in this manner, measure the conductivity of each solution. Refer to the instructions that come with the conductivity meter to determine proper procedures for taking readings. It will be necessary to switch the meter to the correct conductivity range setting to obtain a proper reading. Most synthetic-based foams used with freshwater will result in foam solution conductivity readings of less than 2000 microsiemens. Protein-based foams will generally produce conductivity readings in excess of 2000 in freshwater solutions. Due to the temperature compensation feature of the conductivity meter, it can take a short time to obtain a consistent reading. Once the solution samples have been measured and recorded, set the bottles aside for control sample references. The conductivity readings should then be plotted on the graph paper. It is most convenient to plot the foam solution percentage on the horizontal axis and conductivity readings on the vertical axis. Use a ruler or straightedge to draw a line that approximates connecting all three points. Although it might not be possible to hit all three points with a straight line, they should be very close. If not, repeat the conductivity measurements and, if necessary, make new control sample solutions until all three points plot in a nearly straight line. This plot will serve as the known base (calibration) curve to be used for the test series.

For sampling and analysis, collect foam solution samples from the proportioning system, using care to ensure the sample is taken at an adequate distance downstream from the proportioner being tested. Using foam solution samples that are allowed to drain from expanded foam can produce misleading conductivity readings and, therefore, is not recommended. Once one or more samples have been collected, read their conductivity and find the corresponding percentage from the base curve prepared from the control sample solutions. This test is used to determine the percent concentration of a foam concentrate in the water being used to generate foam and is typically used as a means of determining the accuracy of a system's proportioning equipment. If the level of foam concentrate injection varies widely from design, it could abnormally influence the expansion and drainage foam quality values, which could influence the foam's performance during fire.

Acceptance Test (Refractive Index Method)

The refractive index method of performing the acceptance test includes preparing a base (calibration) curve using the following materials: (i) four 100 ml plastic bottles with caps; (ii) one 10-ml measuring pipette or 10-cc syringe; (iii) one 100 ml graduated cylinder; (iv) three plastic-coated magnetic stirring bars; (v) one handheld refractometer (American Optical Model 10400 or 10441, Atago N1, or equivalent); (vi) standard graph paper; and (vii) a ruler or other straightedge.

The refractive index method typically includes using water and foam concentrate from the system to be tested for making three standard solutions in the graduated cylinder. These samples should include the nominal intended percentage of injection, the nominal percentage plus 1 or 2 percentage points, and the nominal percentage minus 1 or 2 percentage points. When preparing the standard solutions, place the water in the graduated cylinder (leaving adequate space for the foam concentrate) and then carefully measure the foam concentrate samples into the water using the syringe. Care should be taken to not to pick up air in the foam concentrate samples. Pour each measured foam solution from the 100-ml graduate into a 100-ml plastic bottle. Each bottle should be marked to indicate the percent solution it contains. Add a plastic stirring bar to the bottle, cap it, and shake thoroughly to mix the foam solution. After thoroughly mixing the foam solution samples, take a refractive index reading of each percentage foam solution sample. This is done by placing a few drops of the solution on the refractometer prism, closing the cover plate, and observing the scale reading at the dark yield intersection. Since the refractometer is temperature compensated, it can take 10 to 20 seconds for the sample to be read properly. It is important to take all refractometer readings at ambient temperatures of 10° C. (50° F.) or above. Using standard graph paper, plot the refractive index readings on one axis and the percent concentration on the other. The resulting plotted curve will serve as the known baseline for the test series. Set the solution samples aside in the event the measurements need to be checked.

For sampling and analysis, collect foam solution samples from the proportioning system, using care to ensure the samples are taken at an adequate distance downstream from the proportioner being tested. Take refractive index readings of the samples and compare them to the plotted curve to determine the percentage of the samples. This method may not be particularly accurate for AFFF or alcohol-resistant foams, since they typically exhibit very low refractive index readings. For this reason, the conductivity method might be preferred when these products are used.

In alternate embodiments of test system 10, one or more in-line conductivity meters 60 (see FIGS. 1-3) may be installed in the proportioning system for purposes of performing the acceptance test on the solution flowing through solution supply line 32 rather than on solution samples that have been collected after the solution has been discharged from the system. As shown in the Figures, a conductivity meter 60 may be installed in solution supply line 32 downstream from proportioning valve 30 and/or upstream from second flow meter 48. Other placements are possible.

Water Equivalency Test

After an acceptance test has been performed, or after data from a previously performed acceptance test has been obtained, test system 10 may be utilized to generate information for furthering characterizing the performance and function of proportioning valve 30. An acceptance test typically provides quantitative data that indicates how a proportioning system is functioning at the time of the acceptance test; e.g., flow rates through the various lines and water pressure at particular locations in the system, such as at the back of the proportioning valve. Test system 10 is used to perform a "water equivalency" test, the results of which can be compared to the results of previously performed acceptance tests, using only water from source of water 12. No foam concentrate or foam-water solution is required for the water equivalency test.

During a water equivalency test, the proportioning system and test apparatus are both activated. Bypass 24 bypasses or otherwise shuts-off the source of foam concentrate. A portion of the water flowing through water supply line 14 is diverted through first test line 44 into first flow meter 42, where the flow rate of the water is detected and recorded. Water exits first flow meter 42, passes through proportioning valve 30, and enters solution supply line 32. In some embodiments of test system 10, a portion of the water flowing though solution supply line 32 is diverted into second test line 50 and into a second flow meter 48 where the flow rate is detected and recorded. Water flowing through second flow meter 48 is discharged from the system through discharge line 52. In addition to flow rates, water pressure at various locations in the system is also recorded (e.g., psi at the back of the proportioning valve). The information gathered from a water equivalency test is then compared to the acceptance test data to provide a basis for characterizing the operation of the fire fighting or fire suppression system and the proportioning valve, in particular. If the flow rates and pressures recorded during the water equivalency test are relatively close, i.e., comparable, to the flow rates and pressures recorded during an acceptance test, the fire fighting or fire suppression system is likely to be functioning in an acceptable manner. As previously stated, this method uses no foam and eliminates environmental hazards associated with disposal of foam used in other testing processes. This method also reduces expenses by eliminating the use of tanker trucks that are typically used in the testing process.

While the present invention has been illustrated by the description of exemplary embodiments thereof, and while the embodiments have been described in certain detail, it is not the intention of the Applicant to restrict or in any way limit the scope of the appended claims to such detail. Additional advantages and modifications will readily appear to those skilled in the art. Therefore, the invention in its broader aspects is not limited to any of the specific details, representative devices and methods, and/or illustrative examples shown and described. Accordingly, departures may be made from such details without departing from the spirit or scope of the applicant's general inventive concept.

What is claimed:

1. A test system, comprising:

(a) a foam-water proportioning system, wherein the foam-water proportioning system further comprises:

(i) at least one proportioning valve;

(ii) at least one source of water;

(iii) at least one water supply line, wherein the at least one water supply line connects the at least one source of water to the at least one proportioning valve;

(iv) at least one source of foam concentrate;

(v) at least one foam supply line, wherein the at least one foam supply line connects the at least one source of foam concentrate to the at least one proportioning valve; and wherein the at least one proportioning valve mixes water with foam concentrate to form a solution; and (vi) at least one solution supply line, wherein the at least one solution supply line is connected to the at least one proportioning valve;

(b) means for conducting an acceptance test, wherein the acceptance test characterizes the performance of the proportioning valve based on manufacturers' specifications for the proportioning valve;

(c) at least one test apparatus, wherein the at least one test apparatus is connectable to or incorporated into the foam-water proportioning system, and wherein the at least one test apparatus further comprises:

(i) means for bypassing the at least one source of foam concentrate, wherein the means for bypassing the at least one source of foam concentrate is located in or on the at least one foam supply line;

(ii) a first test line, wherein the first test line is connected to both the at least one water supply line and the means for bypassing the at least one source of foam concentrate; and (iii) a first flow meter in fluid communication with at least one of the first test line and the foam concentrate supply line, and wherein the first flow meter is located upstream from the at least one proportioning valve, and wherein the first flow meter measures the flow of water through the first test line and through the proportioning valve when the at least one source of foam concentrate is bypassed; and (d) means for comparing the performance of the proportioning valve as determined by the acceptance test with the flow of water through the first test line when the at least one source of foam concentrate is bypassed for characterizing the performance and function of the proportioning valve and the foam-water proportioning system.

2. The test system of claim 1, wherein the at least one test apparatus further comprises a second test line and a second flow meter, and wherein the second test line connects the solution supply line to the second flow meter.

3. The test system of claim 1, further comprising at least one solution-dispersing device in fluid communication with the solution supply line.

4. The test system of claim 1, further comprising at least one conductivity meter for use in performing the acceptance test, wherein the conductivity meter is installed in the solution supply line downstream from the at least one proportioning valve.

5. The test system of claim 1, further comprising at least one conductivity meter installed upstream from the second flow meter.

6. The test system of claim 1, further comprising at least one in-line booster pump installed in foam supply line.

7. The test system of claim 1, further comprising at least one in-line variable flow orifice located between the at least one source of foam concentrate and the proportioning valve for controlling the flow of foam concentrate into the proportioning valve.

8. The test system of claim 1, wherein the foam-water proportioning system further comprises: premixed foam solution; vacuum inducing proportion; pressure proportioning; bladder tank proportioning; balance pressure proportioning; in-line balanced pressure proportioning; around the pump proportioning; pick-up nozzles; jet pump proportioning; or combinations thereof.

9. The test system of claim 1, wherein the foam-water proportioning system is a sprinkler system.

10. A test method, comprising:

(a) accessing a foam-water proportioning system, wherein the foam-water proportioning system further comprises:
  (i) at least one proportioning valve;
  (ii) at least one source of water;
  (iii) at least one water supply line, wherein the at least one water supply line connects the at least one source of water to the at least one proportioning valve;
  (iv) at least one source of foam concentrate;
  (v) at least one foam supply line, wherein the at least one foam supply line connects the at least one source of foam concentrate to the at least one proportioning valve; and wherein the at least one proportioning valve mixes water with foam concentrate to form a solution; and
  (vi) at least one solution supply line, wherein the at least one solution supply line is connected to the at least one proportioning valve; and (b) means for conducting an acceptance test, wherein the acceptance test characterizes the performance of the proportioning valve based on known specifications for the proportioning valve;

(c) connecting at least one test apparatus to, or incorporating at least one test apparatus into, the foam-water proportioning system, wherein the at least one test apparatus further comprises:
  (i) means for bypassing the at least one source of foam concentrate, wherein the means for bypassing the at least one source of foam concentrate is located in or on the at least one foam supply line;
  (ii) a first test line, wherein the first test line is connected to both the at least one water supply line and the means for bypassing the at least one source of foam concentrate; and
  (iii) a first flow meter in fluid communication with at least one of the first test line and the foam concentrate supply line, and wherein the first flow meter is located upstream from the at least one proportioning valve; and (d) activating the test apparatus, wherein activating the test apparatus further activates the means for bypassing the at least one source of foam concentrate and directs water from the at least one water supply line through the first test line and through the first flow meter;

(e) recording water flow rates through the first flow meter, and (f) comparing the performance of the proportioning valve as determined by the acceptance test with the flow of water through the first test line when the at least one source of foam concentrate is bypassed for characterizing the performance and function of the proportioning valve and the foam-water proportioning system.

11. The method of claim 10, wherein the at least one test apparatus further comprises a second test line and a second flow meter, and wherein the second test line connects the solution supply line to the second flow meter, and further comprising the step of recording water flow rates through the second flow meter following activation of the test apparatus.

12. The method of claim 10, further comprising obtaining manufacturer specified flow rates for the proportioning valve or the results of a previously performed acceptance test and comparing the specified flow rates or acceptance test results with the recorded water flow rates.

13. The method of claim 10, further comprising the step of installing at least one conductivity meter in the solution supply line downstream from the at least one proportioning valve for use in performing the acceptance test.

14. The method of claim 10, further comprising the step of installing at least one conductivity meter upstream from the second flow meter.

15. The method of claim 10, further comprising the step of installing at least one in-line booster pump in the foam supply line.

16. The method of claim 10, further comprising the step of installing at least one in-line variable flow orifice between the at least one source of foam concentrate and the proportioning valve for controlling the flow of foam concentrate into the proportioning valve.

17. The method of claim 10, wherein the foam-water proportioning system further comprises: premixed foam solution; vacuum inducing proportion; pressure proportioning; bladder tank proportioning; balance pressure proportioning; in-line balanced pressure proportioning; around the pump proportioning; pick-up nozzles; jet pump proportioning; or combinations thereof.

18. A test method, comprising:

(a) accessing a foam-water proportioning system, wherein the foam-water proportioning system further comprises:
  (i) at least one proportioning valve;
  (ii) at least one source of water;
  (iii) at least one water supply line, wherein the at least one water supply line connects the at least one source of water to the at least one proportioning valve;
  (iv) at least one source of foam concentrate;
  (v) at least one foam supply line, wherein the at least one foam supply line connects the at least one source of foam concentrate to the at least one proportioning valve; and wherein the at least one proportioning valve mixes water with foam concentrate to form a solution; and
  (vi) at least one solution supply line, wherein the at least one solution supply line is connected to the at least one proportioning valve; and (b) connecting at least one test apparatus to, or incorporating at least one test apparatus into, the foam-water proportioning system, wherein the at least one test apparatus further comprises:
  (i) means for bypassing the at least one source of foam concentrate, wherein the means for bypassing the at least one source of foam concentrate is located in or on the at least one foam supply line;
  (ii) a first test line, wherein the first test line is connected to both the at least one water supply line and the means for bypassing the at least one source of foam concentrate; and
  (iii) a first flow meter in fluid communication with at least one of the first test line and the foam concentrate supply line, and wherein the first flow meter is located upstream from the at least one proportioning valve;

(c) activating the foam-water proportioning system;

(d) means for performing at least one acceptance test to characterize the performance and function of the at least one proportioning valve based on manufacturers' specifications for the proportioning valve;

(e) activating the test apparatus, wherein activating the test apparatus further activates the means for bypassing the at least one source of foam concentrate and directs water from the at least one water supply line through the first test line and through the first flow meter;

(f) recording water flow rates through the first flow meter; and (g) performing a water equivalency test by comparing the recorded water flow rates with the results of the acceptance test to characterize the operation and function of the foam-water proportioning system.

19. The method of claim 18, wherein the at least one test apparatus further comprises a second test line and a second flow meter, and wherein the second test line connects the solution supply line to the second flow meter, and further comprising the steps of recording water flow rates through the second flow meter following activation of the test apparatus, and comparing the recording flow rates with the results of the acceptance test.

20. The method of claim 18, further comprising the step of installing at least one conductivity meter in the solution supply line downstream from the at least one proportioning valve for use in performing the acceptance test.

21. The method of claim 18, further comprising the step of installing at least one conductivity meter upstream from the second flow meter.

22. The method of claim 18, further comprising the step of installing at least one in-line booster pump in the foam supply line.

23. The method of claim 18, further comprising the step of installing at least one in-line variable flow orifice between the at least one source of foam concentrate and the proportioning valve for controlling the flow of foam concentrate into the proportioning valve.

24. The method of claim 18, wherein the foam-water proportioning system further comprises: premixed foam solution; vacuum inducing proportion; pressure proportioning; bladder tank proportioning; balance pressure proportioning; in-line balanced pressure proportioning; around the pump proportioning; pick-up nozzles; jet pump proportioning; or combinations thereof.

* * * * *